3/3/81 XR 4,254,193

United States Patent [19]

Yokono et al.

[11] 4,254,193

[45] Mar. 3, 1981

[54] HOLOGRAM AND METHOD OF PRODUCTION THEREOF FROM POLYSACCHARIDE RECORDING LAYER

[75] Inventors: Koujiro Yokono, Kawasaki; Katsuhiko Nishide, Yokohama, both of Japan

[73] Assignee: Canon Kabushiki Kaisha, Tokyo, Japan

[21] Appl. No.: 64,535

[22] Filed: Aug. 7, 1979

Related U.S. Application Data

[63] Continuation of Ser. No. 819,594, Jul. 27, 1977, abandoned.

[30] Foreign Application Priority Data

Jul. 27, 1976 [JP] Japan ..... 51/89489

[51] Int. Cl.[3] ..... G03C 5/04

[52] U.S. Cl. ..... 430/1; 350/3.61; 427/53.1; 430/2; 430/401

[58] Field of Search ..... 430/1, 2, 945, 401; 427/53.1, 415; 350/3.6, 3.61

[56] References Cited

U.S. PATENT DOCUMENTS

| | | | |
|---|---|---|---|
| 3,567,444 | 3/1971 | Shankoff | 430/1 |
| 3,660,091 | 5/1972 | Shankoff et al. | 350/3.61 X |
| 4,029,507 | 6/1977 | Wehner et al. | 430/2 X |
| 4,172,724 | 10/1979 | Matsumoto et al. | 430/1 |

OTHER PUBLICATIONS

Kosar, "Light-Sensitive Systems", 1965, pp. 46, 53, 64, 125.

*Primary Examiner*—Edward C. Kimlin

*Attorney, Agent, or Firm*—Fitzpatrick, Cella, Harper & Scinto

[57] ABSTRACT

A hologram is produced by forming an interference pattern in a recording carrier composed of a polysaccharide made active to radiation in the presence of a compound containing a metal ion.

20 Claims, 2 Drawing Figures ion capable of forming a coordinate bond with the polymer constituent when irradiated.

The polysaccharide used in the invention may be selected from many varieties of polysaccharide. They are classified into two groups in accordance with their chemical composition. One is a homoglycan which consists of a same kind of monosaccharides and the other is a heteroglycan which consists of two or more different kinds of monosaccharides. Typical examples of each the groups are given below:

1. Homoglycan; cellulose, starch, glycogen, dextran, charonin, laminaran, inulin, levan, mannan, galactan pectin, chitin and alginic acid.
2. Heteroglycan;
   (i) Diheteroglycan hyaluronic acid, neutral polysaccharides of tragacanth gum, glucomannan, galactomannan, guaran, heparin and chondroitin sulfuric acid.
   (ii) Triheteroglycan mesquite gum, ghatti gum, other various plant mucilages, vegetable gum and bacterial polysaccharides.
   (iii) Tetraheteroglycan gum arabic, mucilage of hempseeds, other various mucilages, gum substances and bacterial polysaccharides.
   (iv) Pentaheteroglycan gum substances of cherry and peech.

Products obtainable by chemically treating the above mentioned polysaccharides also may be used in the invention so long as they possess the features of polysaccharide even after the treatment. For example, cellulose derivatives such as water soluble methyl cellulose, ethyl cellulose and carboxymethyl cellulose; dextrin produced by a partial hydrolysis of starch; and salts of alginic acid such as sodium alginate may be used.

Among the above mentioned polysaccharides, those of cellulose type, starch type, alginic acid type and gum arabic of vegetable mucilage are preferably used in the invention in view of availability, cost and properties required for hologram. However, polysaccharides useful for the invention are never limited to the above examples only.

Metal ion used in the invention to form a coordinate bond with the polysaccharide should be able to form a coordinate bond when exposed to radiation, so as to make it possible to form an image at the exposure. Such a metal ion is generally called photosensitive metal ion. Most preferable example thereof is a hexavalent chromium ion. More concretely, mention may be made of dichromates such as sodium dichromate, ammonium dichromate and potassium dichromate, and chromates such as sodium chromate, ammonium chromate and potassium chromate.

As other metal ion, ferric ion also may be used in the invention.

While the above mentioned examples are practically preferable for use in the invention, the compound containing metal ion used in the invention is never limited to those examples only.

Now, the process of producing a hologram by using the above described materials will be described.

Polysaccharide as mentioned above is dissolved in water by a predetermined concentration and the resultant solution is coated onto a support such as a glass plate or a transparent plastic film. If desired, a suitable hardening agent may be added to the coating solution as to obtain a sufficient film strength enough to prevent the formed coating layer from being dissolved out at the next step of development. As another possibility, a hardening treatment may be carried out after exposure but before development. Examples of preferable hardening agent are aldehyde compounds such as formaldehyde and acetaldehyde, dichromate, chromate and alum.

The coating layer is then immersed in a solution of a compound containing metal ion as mentioned above (hereinafter it is referred to as "metal salt" for the sake of simplification of description) in the dark and dried so as to make it photosensitive. In certain cases, it is also possible to initially and the metal salt into the coating solution to have it made photosensitive preliminarily.

The amount of the metal salt to be added to the polysaccharide is generally in the range of from 0.01 to 20 wt% and more preferably in the range of from 0.1 to 10 wt%.

To form a hologram in the hologram recording material prepared in the above described manner, it is subjected to an exposing process and then an amplification is effected through a developing process.

To effect the exposure, radiant rays to which the metal salt is sensitive, preferably mercury lamp or bright line of a laser are employed and two beams of such radiant rays are irradiated on the recording material in such a manner that the two beams may interfere with each other on the material at a predetermined angle.

Developing process comprises steps of action on the exposed material, that is, stabilization by dessolving out the unreacted portion of the metal salt, swelling and shrinking.

The removal of unreacted metal salt can be effected by washing the exposed recording material with a solvent capable of dissolving out the metal salt. Water is preferably used for this purpose. As described above, water is also a solvent for polysaccharides. But, by suitably selecting the washing conditions, for example, by suitably controlling temperature and time of washing, water may be used as a useful washing agent without dissolving the recording medium composed of saccharide.

At this step of washing, swelling is effected simultaneously and it is believed that the recording layer may be swollen in accordance with the pattern of coordinate cross linkage formed in the layer by exposure.

The swollen material is then immersed in a second solvent so as to have it shrunk rapidly. This shrinking process is considered to bring forth such an effect that the unexposed portion of the recording layer where it lacks cross linkage structure is subjected to a tension by the adjacent exposed portion to the extent that there occurs cracks in the unexposed portion and thereby a greater change in refractive index is produced.

The second solvent used in this step should be such a solvent that never affects the saccharide, for example, by swelling action and also that is miscible with the above mentioned washing solvent (first solvent) and has a good volatility in itself. Examples of the second solvent preferably used include: alcohols such as methanol, ethanol and isopropyl alcohol, and ketones such as acetone and methyl ethyl ketone. Isopropyl alcohol is particularly preferable.

The fundamental principle on which the present invention is based is essentially common to that of the conventional technique using dichromate gelatin. But, there is a critical difference between them in the property of polymer used as the recording medium (record-

HOLOGRAM AND METHOD OF PRODUCTION THEREOF FROM POLYSACCHARIDE RECORDING LAYER

This is a continuation, of application Ser. No. 819,594, filed July 27, 1977, now abandoned.

BACKGROUND OF THE INVENTION

1. Field of the Invention

The present invention relates to a hologram and more particularly to a hologram produced by using novel sensitive material, and further to a method of producing the hologram.

2. Description of the Prior Art

Holography is a unique technique of forming an optical image by which an object is irradiated by a well coherent wave such as laser where the wave is modulated in amplitude and phase in accordance with the shape of the object, the modulated wave reflected upon or transmitted through the object is recorded (=hologram) and the hologram is irradiated again by the laser so as to reproduce an optical image of the original object.

With the recent progress of study and research on holography, it has been made clear to a certain extent what material is suitable for use in holography or what characteristics such a hologram recording material should have.

Thus, there have already been proposed various materials such as bleached silver salt (U.S. Pat. No. 3,672,744), photoresist, thermoplastic resin, dichromate gelatin (U.S. Pat. No. 3,617,274), inorganic glass material and ferroelectric substance, and at present a further study on the characteristics of these materials is proceeding in the art.

As described above, holography is a unique and novel information recording system and therefore it necessitates particular hologram recording materials which are able to satisfy much more sever requirements than those of the conventional recording system. Although many attempts and efforts have been made to develope novel and improved materials useful for holography, there has not yet been proposed any recording material having good characteristics and properties enough to completely satisfy the severe requirements.

For example, it has been attempted to use the known silver salt emulsions for the conventional photography also as recording materials for holography, making full use of their excellent properties. However, photographic silver salt emulsion has some important disadvantages. When it is employed to form a hologram, then an information pattern has to be recorded by the density distribution of silver grains through the processes of developing and fixing. The hologram thus obtained is an amplitude modulation type hologram which has a demerit of substantial light loss in reproducing the image.

In the conventional photography, an image of object can be recorded directly. But, in case of holography, the image must be recorded as a very complicate interference pattern and thereby a high resolving power is required. The grain structure inherent in photographic photosensitive emulsion adversely affects for this purpose. For the reason, the use of photographic emulsion in holography is limited.

It is known that a phase modulation type hologram based on not the change in light absorption but the change in refractive index through a recording medium allows to give a high degree of diffraction with less loss in light, compared with the above mentioned amplitude modulation type hologram.

In order to produce such phase type hologram, hitherto have been used bleached type photographic photosensitive emulsion and dichromate gelatin.

It is said that holograms produced by using dichromate gelatin are superior to those produced by using bleached type photographic emulsion in respect to diffraction efficiency, S/N ratio and other properties. However, dichromate gelatin does not allow the production of holograms having adequate stability which is one of the most important properties required for hologram recording materials. In particular, its moisture resisting property is so poor that the recorded hologram may be lost by the action of moisture. This is a critical disadvantage of the material.

SUMMARY OF THE INVENTION

Accordingly it is an object of the present invention to provide a hologram and in particular a volume type phase hologram which eliminates the above described disadvantages and drawbacks, and which has good stability and durability, in particular, against moisture, as well as high diffraction efficiency.

Another object of the present invention is to provide a method of producing such an improved hologram.

To attain the above described objects, according to one aspect of the present invention, there is provided a hologram which is obtained by forming an interference pattern in a recording carrier composed essentially of a polysaccharide made active to radiation by the coexistence of a compound containing a metal ion.

According to another aspect of the invention, there is provided a method of producing the hologram, which is characterized in that a recording carrier composed essentially of a polysaccharide made active radiation by the coexistence of a compound containing a metal ion is exposed to an interference pattern of radiant rays so as to form a hologram in the carrier.

According to still further aspect of the invention, there is provided a method of producing the improved hologram, which comprises the steps of exposing to an interference pattern of radiant rays a recording carrier composed essentially of a polysaccharide made active to radiation by the coexistence of a compound containing metal ions; subjecting the exposed carrier to a swelling treatment with a first solvent; and subjecting the swollen carrier to a shrinking treatment with a second solvent.

Other and further objects, features and advantages of the invention will appear more fully from the following description.

DESCRIPTION OF THE PREFERRED EMBODIMENT

Figure 1:
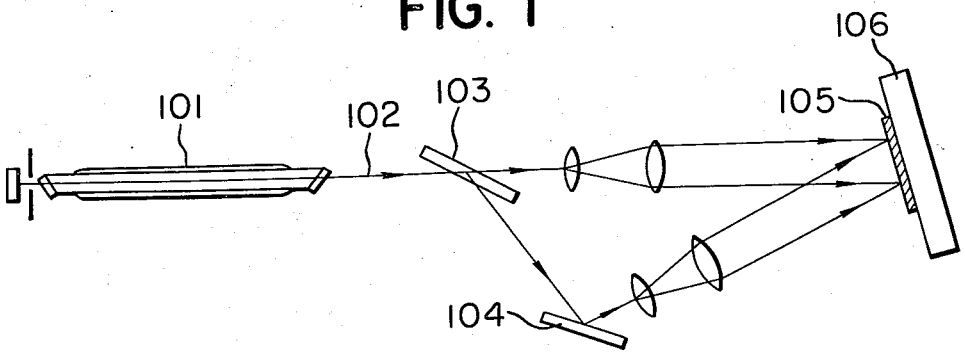
FIG. 1 shows diagrammatically an example of optical system used in producing a hologram according to the invention.

The hologram recording material used in the invention has to comprise at least two constituents, that is, a polymer belonging to polysaccharide by which a carrier is to be formed and a compound containing a metal The dry plate was exposed according to the procedure described in Example 1, washed with warm water at 40° C. for two minutes, immersed in a bath of acetone at 40° C. for two minutes and dried with hot air. In this manner, a hologram was produced.

The hologram was found to have a diffraction efficiency of 40% for 100 mj/cm$^2$ of exposure energy and a good moisture resistance equal to that of Example 1.

EXAMPLE 4

To 10 cc of a 1.96% aqueous solution of methyl cellulose, there was added 1 cc of a 20% aqueous solution of ammonium dichromate and sensitized. The resultant mixture was coated onto a glass plate with a spinner to prepare a dry plate.

After drying at room temperature for two or three hours, the dry plate was heated within an oven for an hour at 50° C.

While carrying out the operations in the dark, the dry plate was exposed in the same manner as in Example 1, washed with warm water at 45° C. for two minutes, immersed in a treating bath of anhydrous isopropanol at 45° C. for one minute and dried with hot air.

In this manner, a hologram was obtained which was found to have a diffraction efficiency of 50% for 100 mj/cm$^2$ of exposure energy and a good moisture resistance.

EXAMPLES 5-6

The procedure of Example 4 was repeated with the change that ethyl cellulose and carboxymethyl cellulose were used in stead of methyl cellulose in Example 4, and sodium dichromate and ammonium chromate were used in stead of ammonium dichromate in Example 4.

In this manner, holograms of Examples 5 and 6 were produced, the characteristics and properties of which are given in the following table including those of the hologram obtained in Example 4.

| Example No. | Polysaccharide | Metal salt | Exposure energy (mj/cm$^2$) | Diffraction efficiency (%) | Moisture resistance |
|---|---|---|---|---|---|
| 4 | methyl cellulose | ammonium dichromate | 100 | 50 | good |
| 5 | ethyl cellulose | sodium dichromate | 100 | 45 | good |
| 6 | carboxymethyl cellulose | ammonium chromate | 100 | 42 | good |

EXAMPLE 7

A 10% aqueous solution of starch was prepared by resolving an amount of commercially available, water soluble starch into warm water. To 20 cc. of the starch solution, there was added 2 cc of a 5% aqueous solution of ammonium dichromate. The resultant mixture was coated onto a glass plate in the same manner as in Example 1 as to make a dry plate.

The dry plate was dried at room temperature and heated for an hour at 50° C. within an oven. Thereafter, it was immersed in a bath of a 10% aqueous solution of ammonium dichromate for one minute so as to sensitize it.

The dry plate was exposed according to the procedure described in Example 1, washed with flowing water for one minute, immersed in a bath of isopropanol at 30° C. for two minutes and dried with hot air.

In this manner, a hologram was produced which was found to have a diffraction efficiency of 30% for 100 mj/cm$^2$ of exposure energy and a good moisture resistance.

EXAMPLES 8-9

The procedure of Example 7 was repeated with the change that carboxymethyl starch and white dextrin were used in place of soluble starch in Example 7 and methyl ethyl ketone and methanol were used in place of isopropanol as second solvent in Example 7.

In this manner, holograms of Examples 8 and 9 were obtained, the characteristics and properties of which are given in the following table including those of the hologram obtained in Example 7.

| Example No. | Polysaccharide | Second solvent | Exposure energy (mj/cm$^2$) | Diffraction efficiency (%) | Moisture resistance |
|---|---|---|---|---|---|
| 7 | soluble starch | isopropanol | 150 | 30 | good |
| 8 | carboxymethyl starch | methyl ethyl ketone | 150 | 35 | good |
| 9 | white dextrin | methanol | 150 | 31 | good |

What we claim is:

1. A method of producing a hologram which comprises the steps of:
   - exposing a recording carrier to an interference pattern of radiant rays, said recording carrier being composed mainly of polysaccharide made active to radiation by the co-existence of a compound containing a metal ion;
   - subjecting the exposed carrier to a swelling treatment with a first solvent and
   - subjecting the swollen carrier to a shrinking treatment with a second solvent
   - whereby the swelling and shrinking treatments cause internal tension and fractures between the exposed and unexposed portions of the recording carrier, thereby enhancing the diffraction efficiency.

2. A method of producing a hologram as claimed in claim 1, wherein said recording carrier is subjected to a film hardening treatment prior to said swelling treatment.

3. A method of producing a hologram as claimed in claim 1, wherein said metal ion is capable of forming a coordinate bond with said saccharide when irradiated by radiant rays.

4. A method of producing a hologram as claimed in claim 1, wherein said compound containing a metal ion is a chromate or dichromate.

5. A method of producing a hologram as claimed in claim 1, wherein said polysaccharide is selected from cellulose-, starch- or alginic acid- polysaccharides.

6. A method of producing a hologram as claimed in claim 1, wherein said polysaccharide is gum arabic.

7. A method of producing a hologram as claimed in claim 1, wherein said metal ion-containing compound in an amount of from 0.01 to 20 percent by weight is added to said polysaccharide.

8. A method of producing a hologram as claimed in claim 1, wherein 0.1 to 10 percent by weight of said ing carrier). Owing to this difference, the present invention has some important advantageous features.

The difference in chemical structure between gelatin and saccharide is found in that the former is basically of a peptide structure containing NH- and CO-groups whereas the latter is of a saccharide structure which does not contain N atom but its main component is composed of alcoholic hydroxyl group and carboxyl group. Therefore, according to the invention in which polysaccharide is used as the recording carrier forming material, the main functional group participating in forming coordinate bond is composed of carbonyl group derived from the hydroxyl group containing no N atom and the carboxyl group.

It is expected as a matter of course that the feature of coordinate bond based upon the structure of polysaccharide will advantageously reflect on the properties of holograms produced therefrom. In fact, as will be seen evidently from the following Examples of the invention, the hologram according to the invention has a remarkedly improved moisture resistance as well as a higher diffraction efficiency in comparison with holograms produced by using dichromate gelatin Another feature of the present invention resides in the solvent treatment to be carried out after the irradiation by radiant rays. The property of the recording carrier such as solubility to solvent and swelling property can be changed by forming the coordinate bonds by irradiating the carrier with radiant rays. The present invention makes use of this phenomenon to amplify the diffraction efficiency. Thus, according to the invention, the diffraction efficiency can be greatly amplified by the above described solvent treatment.

The following Examples are given to illustrate the invention.

EXAMPLE 1

A 35% aqueous solution of gum arabic powder was prepared. To 40 cc of the solution, there was added 2 cc of a 5% aqueous solution of ammonium dichromate and the resultant mixture was coated onto a glass plate at room temperature with a spinner (1H-2 type spinner, made by MIKASA Co., Ltd.). In this manner, a dry plate of about 4μ thickness was prepared.

After drying at room temperature for about 2–3 hours, the dry plate was placed in an oven and heated for an hour at 150° C.

Thereafter, it was immersed in a bath of a 5% aqueous solution of ammonium dichromate for two minutes in the dark so as to sensitize it and then dried at room temperature.

The dry plate was exposed to argon laser (wavelength: 4879 Å) by employing an optical system for producing a hologram as shown in FIG. 1, at the offset angle of 70° and the beam ratio of 1. The exposed, but not yet treated dry plate showed diffraction in a very small degree and the diffraction efficiency thereof was found to be 1% at reading wavelength of 6328 Å.

The exposed dry plate was washed with warm water of 50° C. for five minutes and then immersed in a treating bath of anhydrous isopropanol at 50° C. for two minutes. After the immersion, the dry plate was dried with hot air.

The dry plate thus treated showed a highly increased efficiency as compared with that before the treatment. The spatial frequency of the hologram thus obtained was about 3500 lines/mm and its diffraction efficiency reached to 84% at reading wavelength of 6328 Å when 50 mj/cm$^2$ of exposure energy was employed.

Here, referring to FIG. 1 showing an example of optical system for producing a hologram, the reference numeral 101 designates a laser generator, 102 is a laser, 103 is a beam splitter, 104 is a reflecting mirror, 105 is a dry plate for producing a hologram and 106 designates a light absorption plate.

In order to evaluate the stability of the hologram against moisture, the hologram plate was allowed to stand in the atmosphere of 80% of relative humidity and the change in its diffraction efficiency was continuously observed.

For the purpose of comparison, another hologram was prepared according to the conventional method using dichromate gelatin and the same moisture resistance test was conducted on it.

Figure 2:
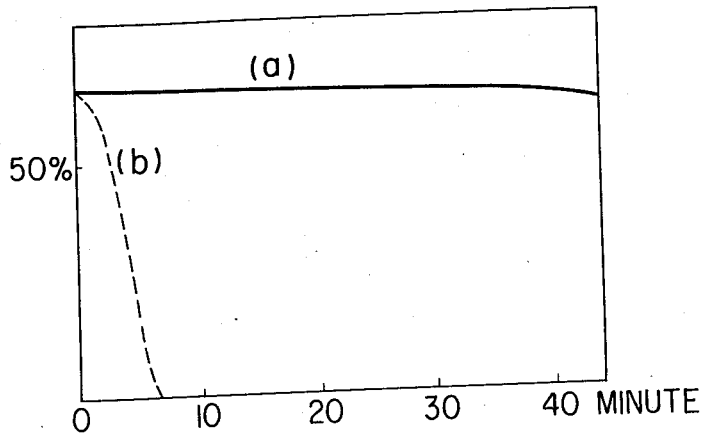
FIG. 2 is a graph showing the results of moisture resistance tests made on a hologram of the invention and the prior art one.

The results of these tests are shown in the graph of FIG. 2 plotted with the diffraction efficiency as the ordinate and the standing time in the atmosphere of 80% R.H. (20° C.) as the abscissa. Curve(a) shows the test result obtained from the hologram of the invention and curve(b) is that for the conventional one produced by using dichromate gelatin. The conventional hologram almost completely lost its capability for diffraction within only several minutes of standing time. On the contrary, the diffraction efficiency of the hologram of the invention was kept unchanged even after standing for thirty minutes. This demonstrates a remarkable improvement of moisture resisting property of the hologram attained by the present invention.

Furthermore, the stability against light of the hologram of the invention was tested by irradiating it with 500 W mercury lamp for an hour. In this test, there was observed no change of hologram, which demonstrates the good stability against light of the hologram of the present invention.

EXAMPLE 2

Employing tragacanth gum, ammonium chromate and ethanol in place of gum arabic, ammonium dichromate and isopropanol (as second solvent) used in Example 1 respectively, the procedure described in Example 1 was repeated so as to form a hologram.

The diffraction efficiency of the hologram thus produced was 50% at the time of 100 mj/cm$^2$ of exposure energy. Its moisture stability was tested in the same manner as in Example 1. The diffraction efficiency remained almost unchanged even after having allowed it to stand for thirty minutes in the atmosphere of 80% R.H. (20° C.). This is enough to say that the moisture resisting property is good. Also, in the following Examples, a hologram is judged to have a good moisture resisting property when its diffraction efficiency remained unchanged after having allowed the hologram to stand for thirty minutes long in the testing atmosphere of 80% R.H. (20° C.).

EXAMPLE 3

To 20 cc of a 2% aqueous solution of commercially available sodium alginate, there was added 1 cc of a 9% aqueous solution of ammonium dichromate. The resultant mixture was coated onto a glass plate in the same manner as in Example 1 to prepare a dry plate.

The dry plate thus prepared was heated in an oven for an hour at 100° C. and then immersed in a bath of a 2% aqueous solution of ammonium dichromate for two minutes so as to sensitize it.

metal ion-containing compound is added to said polysaccharide.

9. A method of producing a hologram as claimed in claim 1, wherein a mixture of said metal ion containing compound and said polysaccharide is formed into a film which constitutes the recording carrier.

10. A method of producing a hologram as claimed in claim 1, wherein said recording carrier is made by forming said polysaccharide into a film and then penetrating a solution of said metal ion-containing compound into the formed film.

11. A method of producing a hologram as claimed in claim 1, wherein said second first solvent is water.

12. A method of producing a hologram as claimed in claim 1, wherein said second solvent is selected from alcohols and ketones.

13. A method of producing a hologram as claimed in claim 1, wherein said radiant ray is a laser.

14. A method of producing a hologram as claimed in claim 1, wherein said radiant ray is such a laser that has a bright line in the range of visible wavelength.

15. A hologram produced by the method of claim 1.

16. A hologram as claimed in claim 15, wherein said metal ion is capable of forming a coordinate bond with said saccharide when irradiated by radiant rays.

17. A hologram as claimed in claim 15, wherein said compound containing a metal ion is a chromate or a dichromate.

18. A hologram as claimed in claim 15, wherein said polysaccharide is selected from cellulose-, starch- and alginic acid- polysaccharides.

19. A hologram as claimed in claim 15, wherein said polysaccharide is gum arabic.

20. A hologram as claimed in claim 15, wherein said interference pattern is a volume type phase hologram.

* * * * *

UNITED STATES PATENT AND TRADEMARK OFFICE

CERTIFICATE OF CORRECTION

PATENT NO. : 4,254,193

DATED : March 3, 1981

INVENTOR(S) : KOUJIRO YOKONO, ET AL.

It is certified that error appears in the above-identified patent and that said Letters Patent is hereby corrected as shown below:

Col. 9, line 13, Claim 11, after "said" delete --second--.

Signed and Sealed this

*Twenty-second* Day of *April 1986*

[SEAL]

*Attest:*

DONALD J. QUIGG

*Attesting Officer*

*Commissioner of Patents and Trademarks*